United States Patent [19]

Menge

[11] 4,370,843

[45] Feb. 1, 1983

[54] WALL SUPPORT BRACE

[76] Inventor: Richard J. Menge, 33 S. Plaza, Rochester, Mich. 48063

[21] Appl. No.: 180,123

[22] Filed: Aug. 21, 1980

[51] Int. Cl.[3] ..... E04C 3/292

[52] U.S. Cl. ..... 52/693; 52/657; 52/659

[58] Field of Search ..... 52/368–377, 52/650, 657, 664, 667, 669, 348–350, 693, 696, 643

[56] References Cited

U.S. PATENT DOCUMENTS

| | | | |
|---|---|---|---|
| 537,483 | 4/1895 | Rapp | 52/669 |
| 656,365 | 8/1900 | McDowell | 52/373 |
| 905,316 | 12/1908 | Hoerle | 52/373 |
| 2,332,059 | 10/1943 | Cheshier | 52/643 |
| 2,389,573 | 11/1945 | Balduf | 52/657 |
| 2,432,622 | 12/1947 | Johnston | 52/368 |
| 3,010,162 | 11/1961 | Klein | 52/369 |
| 3,540,178 | 11/1970 | Attissimo | 52/669 |
| 3,591,997 | 7/1971 | Tennison | 52/669 |
| 3,875,719 | 4/1975 | Menge | 52/669 |
| 4,157,002 | 6/1979 | Adolph | 52/693 X |

*Primary Examiner*—J. Karl Bell

*Attorney, Agent, or Firm*—Gifford, VanOphem, Sheridan and Sprinkle

[57] ABSTRACT

In a wall construction comprising a pair of top plates, a bottom plate and plurality of parallel joists connected between the top and bottom plates, a wall brace is secured in a plurality of aligned saw kerfs to increase the load carrying capability of the wall structure. The brace includes a substantially U-shaped base portion and a pair of side flanges extending normal to the base portion such that the brace is substantially T-shaped in cross section. The brace is specifically designed so that the moment of inertia about the major axis (an axis aligned in the direction of the base) is greater than the moment of inertia about the minor axis (an axis aligned in the direction of the flanges). The preferred construction of the wall structure assures that failure of the brace upon overloading of the wall structure is caused to occur within the plane of the wall. In the preferred construction, the brace is secured to the wall structure by a pair of nails aligned in guide channels within the U-shaped portion of the base at each end of the brace so that the nails extend through the centroid of the brace and reduce torsional moments which tend to urge the brace out of the saw kerfs when a load is applied to the wall structure.

19 Claims, 6 Drawing Figures

WALL SUPPORT BRACE

BACKGROUND OF THE INVENTION

I. Field of the Invention

The present invention relates generally to elongated support braces which are secured across a plurality of parallel joists in a wall structure to resist the tendency of the wall structure to rack under load, and more particularly, to such a brace which is embedded in aligned narrow channels cut transversely into the front surface of each of the plurality of parallel trusses.

II. Description of the Prior Art

Wall frames are typically constructed by securing a plurality of spaced and parallel vertically extending joists or trusses between horizontally extending beams called plates. Although the joists are secured to the plates, additional strengthening of the structure is necessary in order to resist the tendency of the structure to rack under load such as wind or seismic forces and to increase the load carrying capacity of the structure. Thus, a diagonally extending bracing member is often secured across the parallel joists in order to provide such additional support.

One previously known type of wall construction employed wooden brace members having a let-in construction. This let-in construction is formed by providing a plurality of aligned recesses within the parallel truss members and providing correspondingly spaced recesses in a wooden brace member. In this manner, the wooden brace extends across and between the parallel joists and is secured by fasteners such as nails to each of the joists. Such a construction is not only time consuming to cut and construct, but it also requires that the recesses be sufficiently deep to permit paneling or other surface material to be layed flat against the trusses of the wall structure. Moreover, the removal of sections of the trusses in order to form the appropriate recesses increases the infirmity of the completed structure. In addition, testing of these braces and wall construction indicate that when the wall begins to fail because of racking caused by application of an excessive load, the fasteners pull out of the frame members. Consequently, the brace is pulled apart from the wall structure, whereby the strength of the wall structure is decreased.

One previously known device used to overcome the disadvantages of let-in bracing is the T-shaped metal brace such as the braces disclosed in U.S. Pat. No. 3,875,719. The metal support strip is generally T-shaped with a narrow U-shaped portion forming the base leg of the T. The brace is secured across parallel wooden trusses or joists by embedding the base portion of the strip in aligned saw kerfs extending across the joists. The strips are commonly secured by fasteners such as nails to each of the joists which it crosses. While these previously known metal braces have been found to be advantageous over wood let-in construction, it has also been found that a large number of nails is required to secure the strip to the trusses and to insure that the base remains embedded in the saw kerfs. In addition, these previously known strips and wall constructions have not been designed with regard to the inertial characteristics of the strip about the major and minor axes of the T-shaped configuration. Consequently, the maximum strength and maximum strength per dimension have not previously been realized or utilized in T-shaped metal supports for wood structural elements. Moreover, they are inefficient because they do not make full use of the effects resulting from the connection to the joists.

SUMMARY OF THE PRESENT INVENTION

The present invention overcomes the above mentioned disadvantages by providing a brace and a braced wall construction in which the brace is designed as an elongated T-shaped metal brace wherein the cross-sectional properties of the strip are defined by the relationship that the moment of inertia about the major axis ($I_y$) is less that the moment of inertia about the minor axis ($I_x$). The base of the strip is frictionally engaged within each kerf. In addition, the strip is secured to a single wall frame member at each longitudinal end by means secured through the centroid of the metal brace. This additional connection means prevents longitudinal displacement of the strip through the saw kerfs. At the same time, it decreases the effective buckling length of the strip but it also affects the performance of the strip as expected from the cross-sectional properties. Nevertheless, the adverse effect is compensated for by further decreasing the ratio $I_y/I_x$ in the design of the strip. Consequently, the strip can be made of a minimum amount of material and will fail in the desired mode, i.e. flexural buckling, while the connection increases the load capacity and fluxural buckling strength of the brace.

The actual shape of the brace of the present invention is similar to previously known T-shaped metal braces although the actual dimensions of particular portions of the strip of the present invention are not suggested by the previously known T-shaped metal braces. The brace generally comprises a strip of metal having a thickness generally less than one-tenth of an inch (2.54 millimeters) which is cold formed into a returnbent substantially U-shaped base portion and a pair of side flanges extending from the free ends of walls of the base and substantially normal thereto. Unlike previously known T-shaped metal bracing which was not designed to prevent buckling out of the plane of the wall during racking, whereby the nails holding the brace are pulled from the studs, the brace of the present invention is formed so that the cross-sectional properties provide a moment of inertia about an an axis normal to the wall structure which is less than the moment of inertia about an axis parallel to the wall. In accordance with the cross-sectional properties relationship described, the side flanges are substantially narrower than previously known T-shaped metal braces.

By securing the strip to the wall members through its centroid, Applicant further avoids eccentric forces about the centroid of the strip which tend to urge the base of the strip out of the saw kerfs when a racking load is applied to the wall structure. By avoiding the introduction of these forces which are especially likely to occur when a T-shaped metal brace is mounted by nails punched through the laterally extending flanges of the brace, the resistance to racking and failure of the wall structure become highly predictable and the ability of the wall structure to resist racking becomes substantially dependent only upon the cross-sectional characteristics of the T-shaped metal brace. Accordingly, the brace of the present invention avoids the tendency of the brace to buckle out of the plane of the wall even when the use of warped joists predisposes the brace slightly normal to the plane of the wall.

Testing has determined that the connection through the centroid of the strip affects the performance of the cross-sectional properties about the axis normal to the plane of the wall more than about the axis parallel to the plane of the wall, the effect most directly influences the effective buckling length of the strip, but is better described in the context of the present disclosure as producing the effective $I_y$. Nevertheless, appropriate reduction of the $I_y/I_x$ ratio results in a combination strip and connection wherein the flanges of the strip can be reduced without a loss of load capacity as might be expected. Consequently, the brace can be proportioned so that buckling will occur within the plane of the wall, but at higher loads than the previously known and wider wind braces.

A steel brace of the present invention fails in a desired manner, i.e. elastic flexural buckling, under a stress at load:

$$Fa_1 = .522\,QF_y - \left(\frac{QF_y\,\frac{KL}{R}}{1494}\right)^2$$

Wherein the slenderness ratio KL/R is $$O < \frac{KL}{R} < Cc/\sqrt{Q}\,,$$

or inelastic flexural buckling at load:

$$Fa_1 = \frac{151{,}900}{\left(\frac{KL}{R}\right)^2}$$

$$\text{Wherein } \frac{KL}{R} > Cc/\sqrt{Q}\,, \text{ and}$$

K is the ratio of the effective column length to the actual unbraced length,

L is the length of the brace member extending between two adjacent wall structure joists, $$R \text{ is the radius of gyration} = \sqrt{I/\text{Area}}\,,$$

$F_y$ is the yield strength of the brace material, and

Q is a form factor which reduces the effective yield strength due to changes in the effective area of the strip due to stress and the use of stiffened and unstiffened elements in the brace, and the width to thickness ratio of the brace.

Thus, it can be seen that as the ratio $I_x$ to $I_y$ increases the allowable axial stress in the brace for buckling outside the wall becomes significantly greater than the allowable axial stress required to induce buckling within the plane of the wall.

In order to assure that the actual performance of the brace formed from a minimum of material is closely approximated by the above analysis, it is essential that the brace be fastened through its centroid to the wall structure. Actual testing has disclosed that an adequate degree of fixation is provided through the centroid of the brace when the base member is provided with a pair of prepunched nail holes through the central channel of the brace at each end of the brace. Preferably, the two holes at each end of the brace are spaced apart from each other a predetermined distance which enables the enlarged head of one nail to overlap a portion of the enlarged head of the other nail. In addition, the holes are aligned to be parallel to each other and perpendicular to the surface of the joist into which this fastener is embedded.

Prepunching such holes is advantageous since it accurately locates the nails in relation to the member in which it is embedded and thereby eliminates guesswork and improper placement of the nails with respect to the wall plate in which it is embedded. Preferably, the guide holes are located substantially in the center of the wall plate to reduce splitting of the wood or pulling out of the nail. Prepunching also causes a pronounced rib in the base portion of the brace to provide a more positive hold in the saw kerf and to maintain the brace in position while the fasteners are installed.

In addition to reducing the likelihood of improper installation, the rib in the base portion of the brace caused by prepunching also increases the column strength of the base and thereby reduces the likelihood of deformation of the brace when it is being driven into the saw kerf. In addition, a greater portion of the shank of the nail is gripped by the brace member than is provided by merely nailing through an unpunched channel in the base.

Moreover, it has been found that when the holes are prepunched only slightly past the lower corner of the U-shaped channel, installation of the nail within the prepunched hole causes the lower corner of the U-shaped channel to flare out more than would occur by merely nailing the nail through the channel of the wall brace. In addition, the small prepunched opening formed in the bottom of the channel induces a uniform and predictable tearing at the base of the U-shaped channel where the fastener is driven in. This uniformity reduces the likelihood of stress concentrations at the tear lines and thereby reduces premature failure of the wall brace.

In order to maximize the strength of the wall structure, failure of the brace during racking of the wall structure should occur within the plane of the wall, whereby the base of the brace remains embedded within the saw kerfs and continues to support the truss members of the wall construction during racking. The brace of the present invention is especially advantageous in that its design characteristics produce such an effect. At the same time, it is formed from less material than previously known T-shaped metal braces and is thus more economical to produce. Moreover, the wall structure construction has greater load capacity than previously known T-shaped metal braces. Since substantially fewer fasteners are required to secure the brace to the truss wall structure, than in previously known wall structures, installation of the strip of the present invention is easier and faster.

Thus, additional savings in material costs as well as labor costs will be realized by those using the brace member of the present invention.

BRIEF DESCRIPTION OF THE DRAWING

The present invention will be better understood by reference to the following detailed description when read in conjunction with the accompanying drawing in which like reference characters refer to like parts throughout the several views, and in which.

DETAILED DESCRIPTION OF A PREFERRED EMBODIMENT OF THE PRESENT INVENTION

Figure 1:
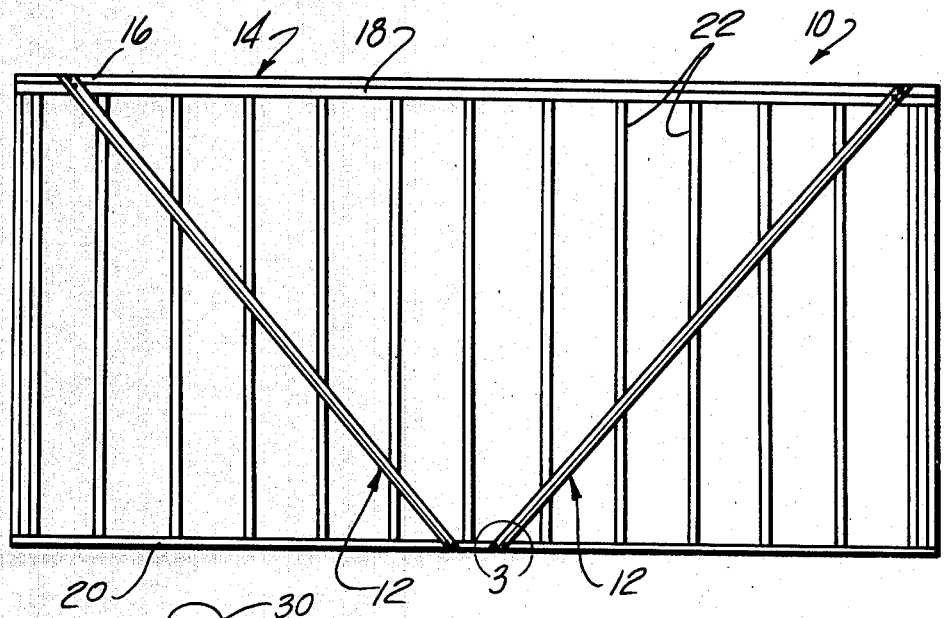
FIG. 1 is an elevational view of a wall structure employng two brace members of the present invention.

Referring now to FIG. 1, the present invention 10 is thereshown comprising brace members 12 secured to the wall structure 14. The wall structure 14 comprises two top plates 16 and 18 supported above a bottom plate 20 by a plurality of joists 22. Each brace 12 is secured at its upper end by appropriate fasteners such as nails 30 to the top plate 16, and the lower end of each brace 12 is secured in like manner to the bottom plate 20. The brace 12 has a base embedded in saw kerfs 21 (FIGS. 5 and 6) within the plates 16, 18, 20 and the joists 22, and are aligned with the axis of the brace 12.

Figure 2:
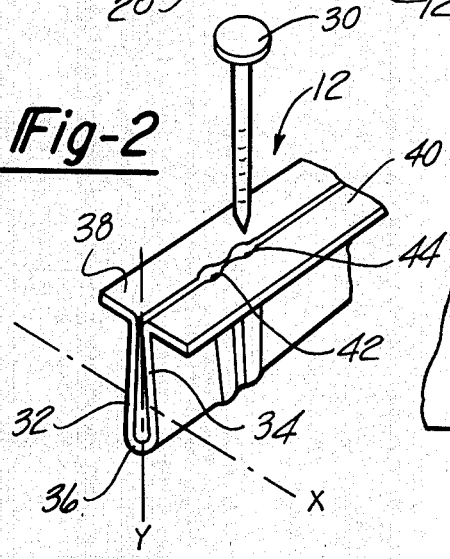
FIG. 2 is a fragmentary perspective view of one end of the brace member of the present invention.

Referring to FIG. 2, an end portion of the brace 12 is enlarged for clarity. The brace is formed from a metal strip approximately 0.038 inches thick or approximately 20 gauge. The strip is return-bent at its center to form the substantially U-shaped channel defined by a pair of base walls 32 and 34 interconnected at the bottom of the channel by the U-shaped corner 36. In practice, the corner 36 is slightly wider than the upper portion of the channel so that the corner is compressed when embedded in a saw kerf. The free ends of the base walls are bent substantially normal to the base legs 32 and 34 to form a pair of side flanges 38 and 40. The cross-sectional properties of the brace about the Y and X axes are determined in accordance with the relationship $I_y < I_x$ when the effect of the connection by fasteners 30 is taken into account. By way of example, a 20 gauge metal support strip 2.3 inches wide has been formed to provide symmetrical flanges 0.404 inches wide and a base extending 752 inches beneath the flange to produce a brace which exhibits the desired performance and load capacity in actual testing.

Figure 3:
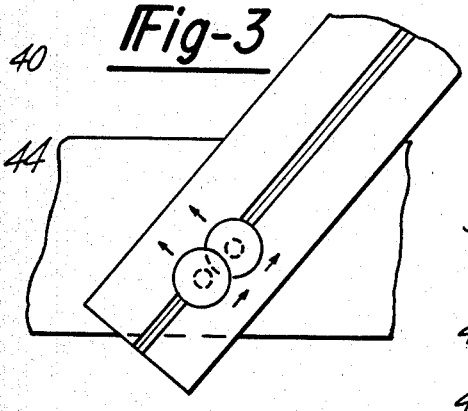
FIG. 3 is an enlarged fragmentary front elevational view of a portion of the wall structure shown in FIG. 1 and enclosed within the circle 3.

When the strip has been so configured to form the brace, a pair of guide channels or holes 42 and 44 are formed between the legs 32 and 34 of the base of the strip. The guide holes 42 and 44 are spaced from the end of the brace 12 so that they are substantially centered at the middle of the top or bottom plate into which the fasteners are to be embedded. In addition, the guide holes 42 and 44 are preferably spaced from each other only a slight distance so that the head of one fastener 30 disposed in one of the guide holes will overlap a portion of the head of the second fastener 30 disposed within the other guide hole. As best shown in FIG. 3, the guide holes 42 and 44, and thus the fasteners 30 disposed in the guide holes 42 and 44 are aligned to intersect the centroid of the metal strip by alignment with the axis of the channel between the base walls 32 and 34.

Figure 4:
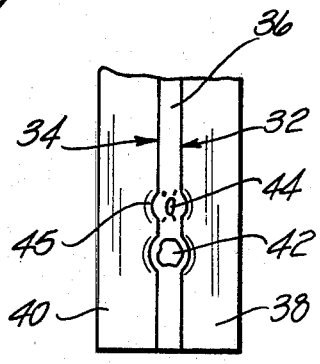
FIG. 4 is a fragmentary bottom plan view of one end of the brace member of the present invention.

Referring now to FIG. 4, the bottom of the end portion of brace 12 shown in FIG. 2 is illustrated. The guide hole 44 is thereshown as it is formed prior to installation of the brace in the wall structure. The base legs 32 and 34 are bulged slightly at 45 and a small aperture less than the diameter of the fastener extends through the bottom 36 of the base of the brace 12. The guide hole 42 shown in FIG. 4 illustrates the condition of the guide hole after a fastener has been inserted through the guide hole. The bulges in the side legs 32 and 34 are slightly more pronounced and the aperture in the bottom corner 36 of the base coincides with the diameter of the fastener which has been inserted through the guide hole 42.

Figure 5:
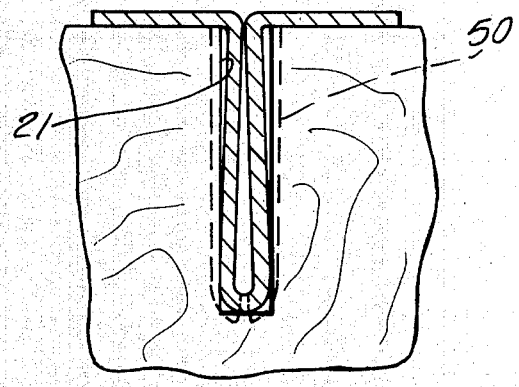
FIG. 5 is a cross-sectional view of the brace member shown in FIGS. 1 through 4.
Figure 6:
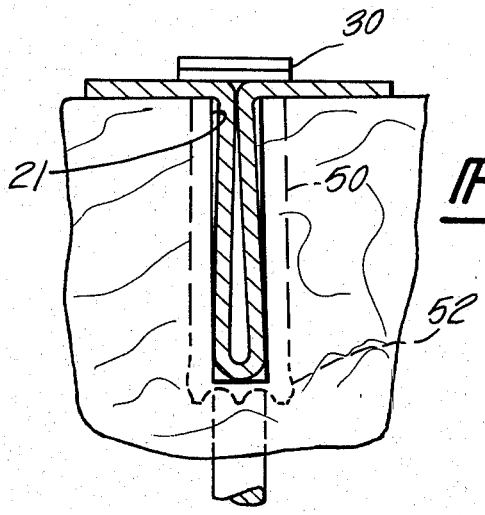
FIG. 6 is a fragmentary cross-sectional view of the brace member similar to FIG. 5 but showing the fasteners installed in the base of the brace.

The additional expansion of the guide holes 42 and 44 is best shown in FIGS. 5 and 6. FIG. 5 is a cross-sectional view of the brace showing a prepunched hole in hidden lines which corresponds to illustration of guide hole 44 in FIG. 4. The line 50 indicates the extension or enlargement 45 of the walls 32 and 34 formed when the guide holes are prepunched. In addition, the line 50 indicates the additional depth to which the brace becomes embedded in the plate beyond the wall of the saw kerf in the joist.

The enlargements 45 become further pronounced when, as shown in FIG. 6, the fasteners are inserted into the guide holes to expand the boundary line 50 even further into the plate surface adjacent the saw kerf. Moreover, engagement of the fastener with the edges of the aperture originally formed in the bottom corner 36 of the base by prepunching the guide holes, spreads the bottom of the base in a bulbous manner as shown at 52 and thus further increases the engagement between the brace and the plate in which it is embedded.

By prepunching the holes 42 and 44 at each end of a brace 12, guides are provided for the fasteners 30 which not only increases the grip between the brace and the fastener, but also increases the fixation of the brace with respect to the wall structure members. The guides act to direct the fasteners through the centroid of the brace and thus eliminate torsional moments about the centroid which tend to rotate the strip within the saw kerf which causes the brace to pull out of the saw kerf under stress. Moreover, performing of the guide holes enables the use of larger nails than would otherwise be easily insertable within the channel of the brace and, thus, further increases the fixation of the brace with respect to the wall structure. In this manner, the need for inserting fasteners through the brace at each joist of the wall structure has been eliminated.

Due to the fact that the braces are rigidly secured to the wall structure without inducing torsional moments about the centroid of the brace, the side flanges 38 and 40 of the brace are substantially smaller than the side flanges of previously known T-shaped wall braces. Such narrowing of the flanges 38 and 40 is advantageous in that it reduces the amount of material necessary to form a brace of the present invention. In addition, the narrow flanges discourage installers from driving fasteners through the side flanges to secure the brace to the wall structure. By eliminating fastening through the side flanges, torsional moments about the centroid of the brace are eliminated. Consequently, these moments, which tend to force the brace out of the saw kerfs when the wall construction is under stress, are reduced significantly enough to permit the brace to fail within the plane of the wall before the brace can be pulled out of the saw kerfs. Therefore, the brace remains effective against greater wall stresses than previously known T-shaped metal braces.

It has been found that the use of sixteen penny nails to fasten a strip 12 to wall structures provides sufficient fixation of the brace to the wall structure. Although such nails are larger and more expensive than nails commonly used to secure metal braces to wall structures at each joist intersection, only four of these nails are required to secure each brace member to a wall structure. Consequently, material costs as well as labor costs are substantially decreased for installation of the brace member of the present invention.

Having thus described my invention, many modifications thereto will become apparent to those skilled in the art to which it pertains without departing from the scope and spirit of the present invention as defined in the appended claims. For instance, it is conceived that prepunched guide holes can be formed along the length of the brace to increase the grip of the brace within the saw kerf in each joist.

What is claimed is:

1. A wooden structure of a building construction comprising:

at least one elongated top plate and at least one elongated bottom plate;

a plurality of spaced wooden truss elements secured to said top and bottom plates;

a narrow, transversely inclined channel in each truss element, and said channels are aligned in a manner to receive a straight metal strip inserted therein;

said metal support strip comprising a base portion generally U-shaped in cross section wherein the opposing sides of said base portion extend generally along a first axis, said U-shaped portion being positioned in said channels, and further comprising two flanges extending outwardly from said U-shaped portion and aligned generally along a second axis normal to said first axis wherein the strip is dimensioned in accordance with the relationship: $I_y$ is less than $I_x$, wherein $I_y$ is the moment of inertia about said first axis and $I_y$ is the moment of inertia about said second axis; and first means for fixedly securing said strip to the wooden structure.

2. The invention as defined in claim 1 wherein the strip is dimensioned such that the effective $I_y$ is less than $I_x$ when said first means has been installed, whereby upon application of an excessive load to the structure, the brace fails by flexural buckling in the plane of the wall.

3. The invention as defined in claim 1 wherein said first means comprises compression of said base portion within said inclined channels.

4. A metal support brace for building construction comprising an elongated strip return-bent about its longitudinal axis to form a base portion having two walls defining a first channel therebetween and further comprising two flanges extending substantially normal from said base walls whereby the strip is substantially T-shaped in cross section, said strip further comprising at least one second guide channel substantially perpendicular to said flanges formed in said base walls near each end of said strip by forcing a punch into said channel.

5. The invention as defined in claim 4 wherein said second channel is elongated to a depth slightly greater than the bottom of said U-shaped portion.

6. The invention as defined in claim 4 wherein each said second guide channel is spaced at a predetermined distance from the longitudinal end of said strip.

7. An elongated metal support strip for use in a wooden structure having at least one elongated wooden top plate, at least one elongated wooden bottom plate and a plurality of spaced wooden truss elements secured to said top and bottom plates, wherein each said truss element includes a narrow transversely inclined channel and said channels are aligned in a manner to receive a straight, metal strip therein, said strip comprising:

a base portion generally U-shaped in cross section wherein the opposing sides of said U-shaped base portion extend generally along a first axis;

a pair of side flanges extending outwardly from the free ends of the opposing side walls of said U-shaped base portion, and aligned generally along a second axis normal to said first axis; and wherein the strip is dimensioned in accordance with the relationship: $I_y$ is less than $I_x$, wherein $I_y$ is the moment of inertia about said first axis, and $I_x$ is the moment of inertia about said second axis.

8. The invention as defined in claim 7 wherein the strip is dimensioned such that $I_x$ becomes less than the effective $I_y$ when means for securing the strip to the wooden structure secures the strip to the structure.

9. The invention as defined in claim 7 wherein said side flanges are symmetrical with respect to said base portion.

10. The invention as defined in claim 9 wherein each of said guide channels is formed by punching a rod member downwardly between the opposing walls of said base portion.

11. A wooden structure of a building construction comprising:

at least one elongated top plate and at least one elongated bottom plate;

a plurality of spaced wooden truss elements secured to said top and bottom plates;

a narrow, transversely inclined channel in each truss element, and said channels are aligned in a manner to receive a straight metal strip inserted therein;

said metal support strip comprising a base portion generally U-shaped in cross section wherein the opposing sides of said base portion extend generally along a first axis, said U-shaped portion being positioned in said channels, and further comprising two flanges extending outwardly from said U-shaped portion and aligned generally along a second axis normal to said first axis wherein the strip is dimensioned in accordance with the relationship: $I_y$ is less than $I_x$, wherein $I_y$ is the moment of inertia about said first axis and $I_y$ is the moment of inertia about said second axis;

first means for fixedly securing said strip to the wooden structure; and wherein said first means further comprises second means for securing the strip to one wooden element near each end of said strip, said means being aligned with respect to said U-shaped portion such that the strip is secured through its centroid whereby the eccentric forces about the axis of the U-shaped portion is substantially zero.

12. A metal support brace for building construction comprising an elongated strip return-bent about its longitudinal axis to form a base portion having two walls defining a first channel therebetween and further comprising two flanges extending substantially normal from said base walls whereby the strip is substantially T-shaped in cross section, said strip further comprising at least one second guide channel substantially perpendicular to said flanges formed in said base walls near each end of said strip by forcing a punch into said channel and wherein said at least one guide channel comprises two or more guide channels and wherein one of said two or more guide channels is spaced from an adjacent one of said two or more guide channels a predetermined distance, whereby when a nail having an enlarged head is inserted in said one channel, a portion of the head of a like fastener inserted in said adjacent channel overlaps a portion of the head of said fastener in said one channel.

13. The invention as defined in claim 12 and further comprising at least two guide channels within said base portion extending along said first axis slightly past the lowermost portion of said U-shaped base, said channels being dimensioned to peripherally engage a nail inserted therethrough.

14. The invention as defined in claim 13 wherein each group of said two or more guide channels is spaced at a second predetermined distance from a longitudinal end of said metal support strip, whereby each group of guide channels will be aligned substantially near the center of the outermost wooden member of a wooden support structure.

15. A wooden structure of a building construction comprising:

at least one elongated top plate and at least one elongated bottom plate;

a plurality of spaced wooden truss elements secured to said top and bottom plates;

a narrow, transversely inclined channel in each truss element, said channels being aligned in a manner to receive a straight metal strip inserted therein;

said metal support strip comprising a base portion generally U-shaped in cross section wherein the opposing sides of said base portion extend generally along a first axis, said U-shaped portion being positioned in said channels, and further comprising two flanges extending outwardly from said U-shaped portion and aligned generally along a second axis normal to said first axis wherein the strip is dimensioned in accordance with the relationship: $I_y$ is less than $I_x$, wherein $I_y$ is the moment of inertia about said first axis and $I_y$ is the moment of inertia about said second axis;

first means for fixedly securing said strip to the wooden structure; and wherein said means comprises at least one guide channel near each end of said strip and formed in said U-shaped portion, and a fastener frictionally engaged in each channel.

16. The invention as defined in claim 15 wherein each of said guide channels is spaced at a predetermined distance from the longitudinal end of said strip whereby said guide channels are aligned substantially near the center of said first top plate and the bottom plate, respectively.

17. The invention as defined in claim 15 wherein said at least one guide channel comprises two or more guide channels near each end of said strip, and wherein each of said two or more channels is spaced from an adjacent channel a predetermined distance whereby when a nail having an enlarged head is inserted in one of said two or more channels, a portion of the head of a like fastener inserted in an adjacent one of said two or more channels overlaps a portion of the head of said fastener in said one channel.

18. The invention as defined in claim 15 wherein said guide channel includes an aperture extending through the lowermost portion of said U-shaped portion.

19. An elongated metal support strip for use in a wooden structure having at least one elongated wooden top plate, at least one elongated wooden bottom plate and a plurality of spaced wooden truss elements secured to said top and bottom plates, wherein each said truss element includes a narrow transversely inclined channel and said channels are aligned in a manner to receive a straight, metal strip therein, said strip comprising:

a base portion generally U-shaped in cross section wherein the opposing sides of said U-shaped base portion extend generally along a first axis;

a pair of side flanges extending outwardly from the free ends of the opposing side walls of said U-shaped base portion, and aligned generally along a second axis normal to said first axis;

wherein the strip is dimensioned in accordance with the relationship: $I_y$ is less than $I_x$, wherein $I_y$ is the moment of inertia about said first axis, and $I_x$ is the moment of inertia about said second axis;

wherein said side flanges are symmetrical with respect to said base portion; and wherein two or more said guide channels are provided near each longitudinal end of said support strip and wherein each guide channel of said two or more guide channels is spaced from an adjacent guide channel a first predetermined distance, whereby a portion of the enlarged head of a nail inserted through one guide channel of said two or more guide channels overlaps a portion of the enlarged head of a like nail inserted in said adjacent channels.

* * * * *